US011596844B2

(12) United States Patent
Gopalakrishnan et al.

(10) Patent No.: US 11,596,844 B2
(45) Date of Patent: Mar. 7, 2023

(54) EDUCATIONAL TOOL FOR ROCK CLIMBING

(71) Applicant: WiSys Technology Foundation, Inc., Madison, WI (US)

(72) Inventors: Gokul Gopalakrishnan, Platteville, WI (US); Seneida Biendarra, Sheboygan, WI (US); Robert Matthew Hebel, New London, WI (US); Chloe Lauren Dienst Thomas, Batavia, IL (US); Brian William Tuttle, Neenah, WI (US)

( * ) Notice: Subject to any disclaimer, the term of this patent is extended or adjusted under 35 U.S.C. 154(b) by 152 days.

(21) Appl. No.: 17/066,537

(22) Filed: Oct. 9, 2020

(65) Prior Publication Data

US 2021/0106895 A1 Apr. 15, 2021

Related U.S. Application Data

(60) Provisional application No. 62/912,837, filed on Oct. 9, 2019.

(51) Int. Cl.

| | |
|---|---|
| ***A63B 69/00*** | (2006.01) |
| ***A63B 23/12*** | (2006.01) |
| ***A63B 21/00*** | (2006.01) |
| ***A63B 23/16*** | (2006.01) |
| ***A63B 21/16*** | (2006.01) |

(52) U.S. Cl.
CPC .... *A63B 69/0048* (2013.01); *A63B 21/00047* (2013.01); *A63B 23/12* (2013.01); *A63B 23/16* (2013.01); *A63B 21/1663* (2013.01)

(58) Field of Classification Search
CPC ..... A63B 21/00047; A63B 21/1618; A63B 21/1663; A63B 21/4017; A63B 21/4019; A63B 21/4021; A63B 23/12; A63B 23/16; A63B 69/0048; A63B 9/00; A63B 27/00; A63B 27/02; A63B 27/04
See application file for complete search history.

(56) References Cited

U.S. PATENT DOCUMENTS

| | | | | |
|---|---|---|---|---|
| 10,758,803 | B2 * | 9/2020 | Morse | A63B 69/0048 |
| 10,821,313 | B2 * | 11/2020 | Tuller | A63B 21/0722 |
| 11,305,168 | B2 * | 4/2022 | Smith | A63B 9/00 |
| 2006/0192066 | A1 * | 8/2006 | Mills | A63B 69/0048 248/314 |
| 2018/0140922 | A1 * | 5/2018 | Greer | A63B 69/0048 |
| 2020/0171369 | A1 * | 6/2020 | Sudeith | A63B 69/0048 |
| 2020/0289898 | A1 * | 9/2020 | Wagner | A63B 29/024 |
| 2021/0129001 | A1 * | 5/2021 | Bennett | A63B 71/0622 |

* cited by examiner

*Primary Examiner* — Megan Anderson
(74) *Attorney, Agent, or Firm* — Boyle Fredrickson, S.C.

(57) ABSTRACT

A climbing practice board provides a panel having both threaded holes for the receipt of anchors and support holes allowing attachment of the practice board to a variety of elevated supports.

15 Claims, 5 Drawing Sheets

EDUCATIONAL TOOL FOR ROCK CLIMBING

CROSS REFERENCE TO RELATED APPLICATION

This application claims the benefit of U.S. provisional application 62/912,837 filed Oct. 9, 2019, and hereby incorporated by reference.

BACKGROUND OF THE INVENTION

The present invention relates to a portable training and practice system for people who engage in outdoor rock climbing and related activities, such as technical caving and canyoneering.

Rock-climbing is now emerging as a mainstream recreational activity, thanks in part to the growth of indoor climbing gyms and the appearance of permanent, fixed hardware at outdoor crags. This latter hardware can be used both in "free climbing" where it serves as an attachment point for rope used as a safety measure and also for "aid climbing" where the climber's weight is supported on the hardware during ascent.

The proper use of fixed and removable hardware, including bolt anchors, camming devices, and the like, can take time to master and ideally requires one-on-one instruction and considerable practice.

SUMMARY OF THE INVENTION

The present invention provides a practice board for practicing the use of climbing fixtures such as bolt hangers and climbing holds and provides climbing exercises through the use of a finger board attached to the practice board using standard bolts received by threaded inserts. A set of mounting holes allows the practice board to be quickly installed on a variety of elevated supports including a tree, horizontal beam, door etc., using any of a wide variety of ropes, straps, carabiners or the like.

Specifically, in one embodiment, the invention provides a climbing practice board having a panel with a front surface having a lateral and vertical extent. The panel includes at least a first and second attachment hole exposed at the front surface and holding corresponding threaded inserts, each for receiving and retaining a bolt for attaching a climbing fixture to a front face of the panel and at least two laterally opposed mounting holes positioned on opposite left and right sides of the panel and flanking the first and second attachment holes, the mounting holes adapted to mount the panel to an elevated support with the front face substantially vertical for training a user supported by an attached climbing fixture.

It is thus a feature of at least one embodiment of the invention to provide a simple and affordable training aid for the use of common fixed hardware used in rock-climbing. The mounting holes allow an orientation of the panel vertically at head height for a more realistic training environment.

The practice board may further include one or more rock bolt hangers as the climbing fixtures, the rock bolt hangers providing a metal angle with a first ear portion having a hole for receiving a bolt to attach the ear portion against the front surface by tightening the bolt within the threaded insert and having a loop portion extending substantially perpendicularly from the ear portion providing an aperture for receiving therethrough a rope, strap, or carabiner.

It is thus a feature of at least one embodiment of the invention to allow a user to gain familiarity with using rock bolt hangers normally permanently affixed at high elevations along a climbing route and thus providing limited training opportunity.

The mounting holes may be positioned above the attachment holes when the front face is substantially vertical and may have a dimension along the front face of at least three quarters of an inch with rounded chamfers on their edges to receive ropes or straps with reduced cutting and wear, and maybe positioned within 2 inches of an upper horizontal edge of the panel to be engaged with a carabiner.

It is thus a feature of at least one embodiment of the invention to address a variety of different mounting situations to allow users to have ready access to this training device indoors or outdoors in home or school environments. The large mounting holes provide great flexibility in attaching ropes or straps and carabiners that in turn allow a variety of different elevated support surfaces to be used to hold the panel. Placement of the mounting holes above the attachment holes provides increased stability to the practice board by employing tension on either the hangar or straps to push the mounting board against its supporting surface.

In one embodiment, the panel may include at least four attachment holes exposed at a front surface of the panel and holding corresponding threaded inserts for receiving and retaining a bolt for fixing a bolt hanger to a front face of the panel.

It is thus a feature of at least one embodiment of the invention to allow a variety of different configurations in the attachment of climbing fixtures to the panel, and for example, when used with a fingerboard, to change the orientation of that fingerboard.

The front face may have a lateral dimension of less than 2 feet and a vertical dimension of less than 1 foot and a thickness less than 2 inches.

It is thus a feature of at least one embodiment of the invention to provide an extremely compact, portable, and accessible training aid compared to standard climbing walls or other training surfaces.

The panel may be plywood.

It is thus a feature of at least one embodiment of the invention to provide a training aid that can use sustainable materials while providing a robust and lightweight form factor.

A rear face of the panel opposite the front face may include at least one elastic (elastomeric or soft fiber-based) bumper extending rearwardly from the rear face.

It is thus a feature of at least one embodiment of the invention to minimize damage to mounting surfaces such as trees, walls, or the like when the climbing practice board supports substantial weight.

The climbing board may further include a fingerboard as the climbing fixture, the fingerboard providing a second panel having bolt holes adapted to receive bolts to attach the second panel to the front surface using the attachment holes and in a first orientation providing at least one pair of laterally spaced finger slots sized to receive fingertips of the user for supporting the user by fingertips on the second panel.

It is thus a feature of at least one embodiment of the invention to provide both skill and strength training through the use of supported finger slots.

The fingerboard may be further adapted to receive the bolts to attach the second panel to the front surface in a second orientation rotated with respect to the first rotation providing laterally opposed outwardly concave walls sized to support the user pinching inward on the concave walls with the user's fingertips.

It is thus a feature of at least one embodiment of the invention to provide a fingerboard offering two different, types of finger strengthening exercises.

The fingerboard may provide mounting holes at its opposite ends flanking the outwardly concave walls and finger slots.

It is thus a feature of at least one embodiment of the invention to allow the fingerboard to be independently supported by the mounting holes for use without the panel or to be separated from the panel, for example, as a chock to hold the panel supported on a door. In this regard, the climbing practice board may include a first and second strap each sized to connect between a corresponding second panel mounting hole and the panel mounting hole and drape over the upper surface of a closed door to support the panel on the straps on a first side of the closed door retained against movement by the fingerboard abutting a second side of the closed door.

In one embodiment, the climbing practice board may include a clip releasably supporting a smart phone.

It is thus a feature of at least one embodiment of the invention to provide a climbing board suitable for self-instruction, for example, via a smart phone.

The climbing practice board may further include one or more climbing holds having an outer irregular surface simulating a protrusion from a rocky face.

It is thus a feature of at least one embodiment of the invention to provide a support surface for a wide variety of climbing holds that may be used for practice and strength training.

In one embodiment, the climbing board may include at least two legs that extend downwards for supporting the panel above the ground.

It is thus a feature of at least one embodiment of the invention to provide a climbing board that can be used against any sturdy wall without additional mounting points or mechanisms and in particular when there is not an elevated support surface providing an attachment point.

These particular objects and advantages may apply to only some embodiments falling within the claims and thus do not define the scope of the invention.

DETAILED DESCRIPTION OF THE PREFERRED EMBODIMENT

Figure 1:
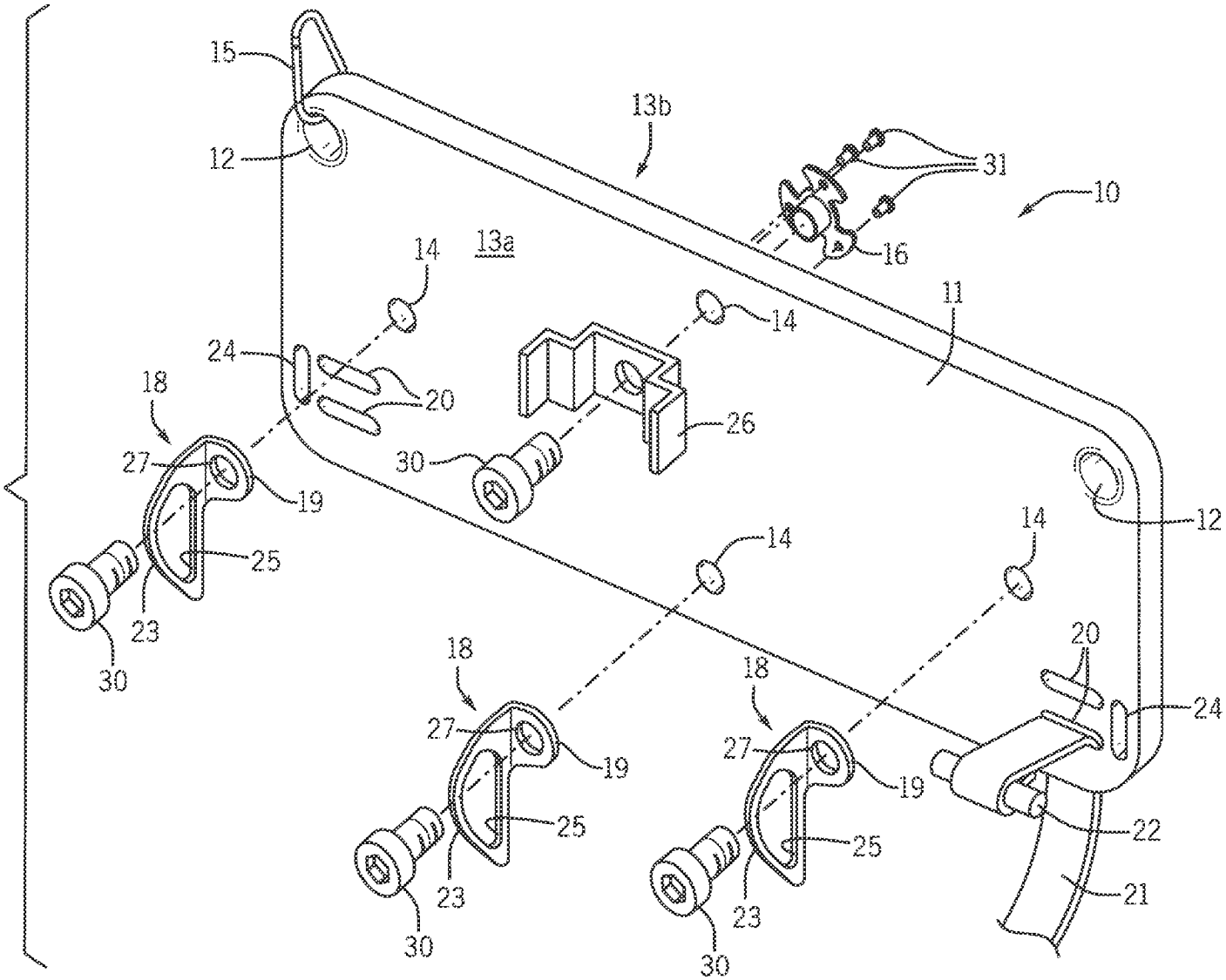
FIG. 1 is an exploded perspective view of an example climbing board showing a climbing board's climbing fixtures in the form of bolt hangers attached using bolts.

Referring now to FIG. 1, an example technical skills practice climbing board 10 may include a generally rectangular panel 11, for example, constructed of plywood, for example, finished with a water-resistant coating or a composite polymer material. In one embodiment, the panel may be nominal three quarters of an inch-thick birch plywood and have a horizontal dimension (as oriented during use) of approximately 16 inches and a vertical dimension of approximately 6 inches. The corners of the panel 11 may be rounded in the plane of the panel (at least ½ inch radius) and all edges of the panel may be given a rounded chamfer (at least ⅛ inch fillet) to reduce sharp edges that could create undue wear on a rope, or a backpack or other bag/container used to carry the board.

As oriented during use and as depicted in FIG. 1, the panel 11 of the climbing board 10 presents a substantially vertical front surface 13*a* and a vertical rear surface 13*b*. Support holes 12 may be cut through the thickness of the panel 11 on its left and right upper corners for attaching the climbing board 10 to a support surface elevated above the ground during use. The edges of the support holes 12 may also have rounded chamfers to reduce cutting and wear on ropes, straps or other soft materials that make repeated contact with the board. Generally, the support holes 12 will be within 2 inches and desirably within 1 inch of the upper and closest side edge of the panel 11 to allow them to be easily engaged by a standard carabiner 15 providing one support option. The support holes may be larger than three quarters of an inch in diameter to readily receive ropes, straps, or the like, and will preferably support a downward force of at least 400 pounds supported by the panel 11.

The front surface 13*a* exposes a plurality of attachment holes 14 below the support holes 12 cut through the thickness of the panel 11. Each attachment hole 14 may receive a threaded insert 16 in the form of a T-nut having a rear flange 17 that may fit flush with the rear surface 13*b* in a counterbore or the like (not shown) and be retained by one or more screws 31 against twisting or removal.

Desirably the attachment holes 14 are positioned between the support holes 12 and are no higher than the support holes 12.

The attachment holes 14 with the corresponding threaded inserts 16 may receive bolts 30 to attach bolt hangers 18 to the front surface 13*a* of the panel 11. In one embodiment, the threaded inserts 16 may receive standard ⅜ or ½ inch bolts having UNC or UNF threads. A bolt hanger suitable for use with the present invention is commercially available from ClimbTech of Austin, Tex. In one embodiment, the bolt hangers 18 may provide for an attachment tab 19 having a hole 27 for receiving the bolt 30 therethrough to be drawn flat against the front surface 13*a*. A rear surface of the attachment tab 19 contacting the front surface 13*a* may be textured to reduce the tendency of the attachment tab 19 to rotate. The attachment tab 19 may be attached to a perpendicularly extending ear 23 providing an opening 25 for receiving ropes, carabiners, or other climbing equipment. Additional attachment holes 14 may be placed at different heights and horizontal spacings on the panel 11, for example, to allow for centered, vertically opposed bolt hangers 18 for placement of other climbing fixtures.

Referring still to FIG. 1, the climbing board 10 may provide opposed pairs of horizontally oriented and vertically separated strap slots 20 preferably located near a lower edge of the panel 11 on left and right edges. The strap slots 20 are sized to receive a corresponding woven polymer strap 21 having a loop end that may be restrained within the straps slot 20 by a dowel 22 for supporting the panel 11, for example, against a door as will be described below. In this regard, the strap slots 20 may have a lateral width of 1 to 2 inches and a height of approximately ¼ inch to ¾ inch for easy threading. The strap slots 20 may also have their edges chamfered to eliminate sharp cutting surfaces. Additional vertical slots 24 of the same dimension may be placed outwardly from the strap slots 20 flanking the strap slots 20 to provide an alternative attachment point for straps used, for example, to tighten the panel 11 against a vertical support like a tree trunk or the like or to mount the panel 11 "vertically"(rotated 90 degrees with respect to the depiction of FIG. 1) with straps or ropes being received by one vertical slot 24 and one of the support holes 12.

A smart phone holder 26 may be affixed to the front surface 13*a* using any of the attachment holes 14 to allow a user to releasably attach his or her smart phone to the front surface 13*a*. The smart phone holder 26 allows the user to watch an instructional video or follow a step-by-step guide while practicing technical climbing skills.

Figure 2:
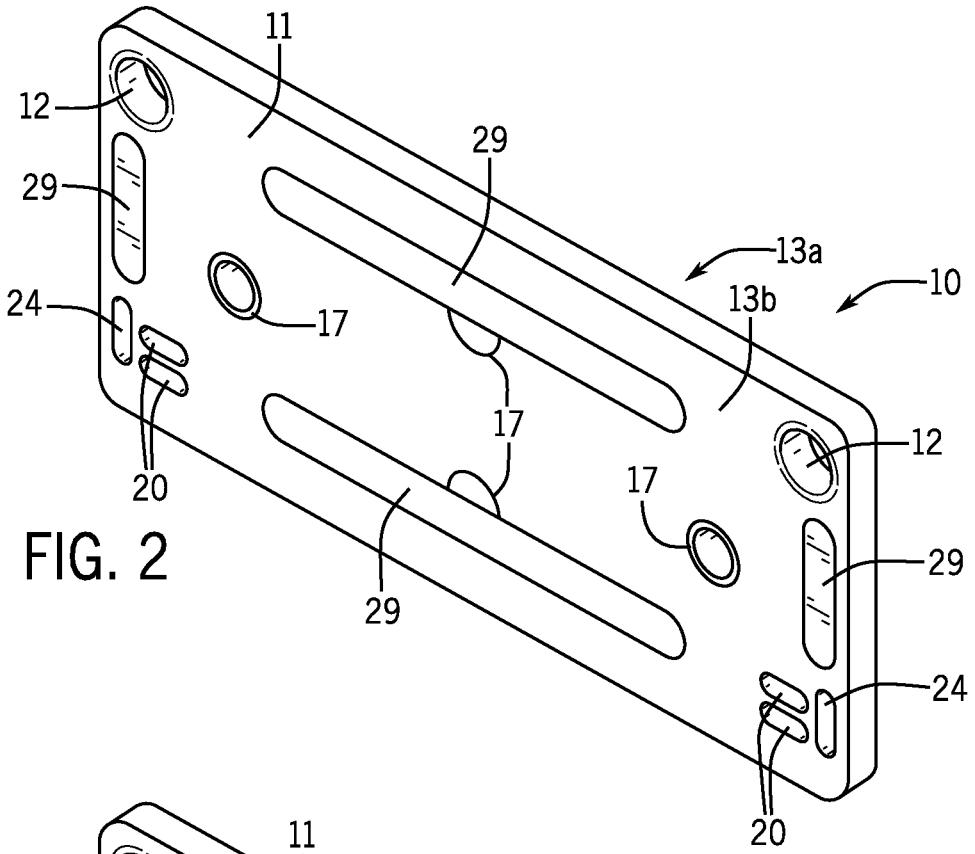
FIG. 2 is a rear perspective view of the climbing board of FIG. 1, showing rear bumper surfaces.
Figure 3:
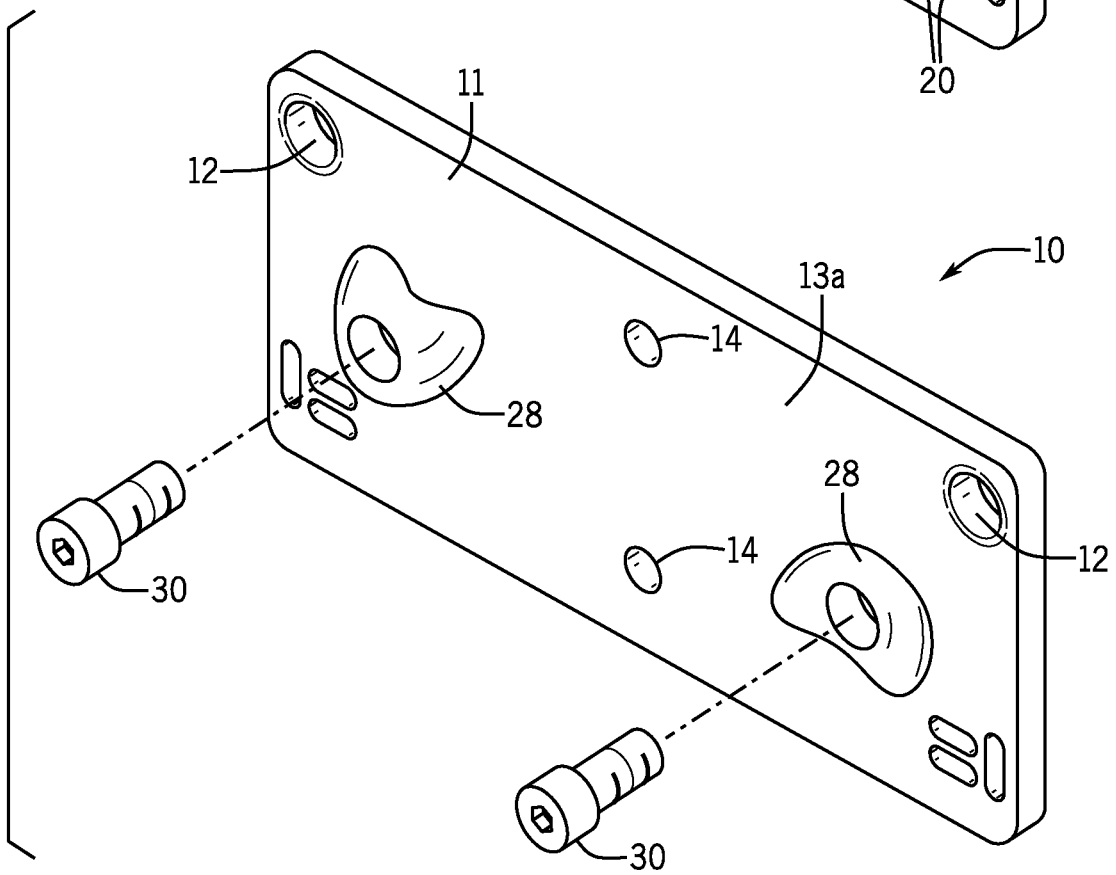
FIG. 3 is a figure similar to that of FIG. 1 showing the climbing board with attached climbing holds as the climbing fixtures.

Referring now to FIG. 2, the rear surface 13*b* of the panel may provide for multiple elastic (elastomeric or soft fiber or the like) bumper pads 29, for example, retained in shallow grooves of similar dimension in the rear surface 13*b* and projecting slightly therefrom. These bumper pads 29 ensure that forces on the panel 11 which may provide high pressures at point contacts to tree hark, doors, walls and the like are reduced to minimize damage thereto.

Referring now to FIG. 2, one embodiment of the climbing board 10 may also provide a climbing hold 28 that may be attached to the face of the panel 11 using a bolt 30, such as shown in FIG. 1, allowing users to pull himself or herself up to practice technical climbing skills. The climbing hold 28 may be made of polyurethane or a polyurethane mixture, similar to that of the holds used in climbing gyms and is configured to imitate a natural rock feature that may be gripped during climbing. In this case, the bolt 30 may be a cap screw providing an Allen wrench head countersunk within the climbing hold 28.

Generally, the climbing board 10 may be affixed to a tree trunk, for example, by cinching a woven strap having multiple loops (termed a daisy chain) around the tree trunk. The mounting support holes 12 may then be attached to appropriate loops of the daisy chain by means of carabiners 15. Alternatively, the climbing board 10 may be attached to a horizontal beam such as a pull up bar positioned in a door, using a set of appropriately sized woven straps having loop ends, with the straps looped over the bar and attached together by the carabiner 15 to the mounting support hole 12. Additional mounting techniques will be discussed below. As noted, in this regard, the support holes 12 may be positioned close enough to the edges of the climbing board 10 to allow them to be fit within a standard carabiner, for example, having a 22 mm gate opening and a D shape. As so attached, the climbing board 10 may support the weight of a user while that person is practicing technical climbing skills. Ideally the climbing board 10 is supported with the surfaces 13 substantially vertical and slightly (e.g., 12-24 inches) above the user's line of sight when the user 33 is standing on the ground 34 or supported on an etrier attached to strap slots 20. At this height, an instructor can readily offer instruction to the user while the instructor stands on the ground or the etrier, for example, being a nylon strap at least 10 to 20 feet long and having a working strength of over 200 pounds tension.

Figure 4:
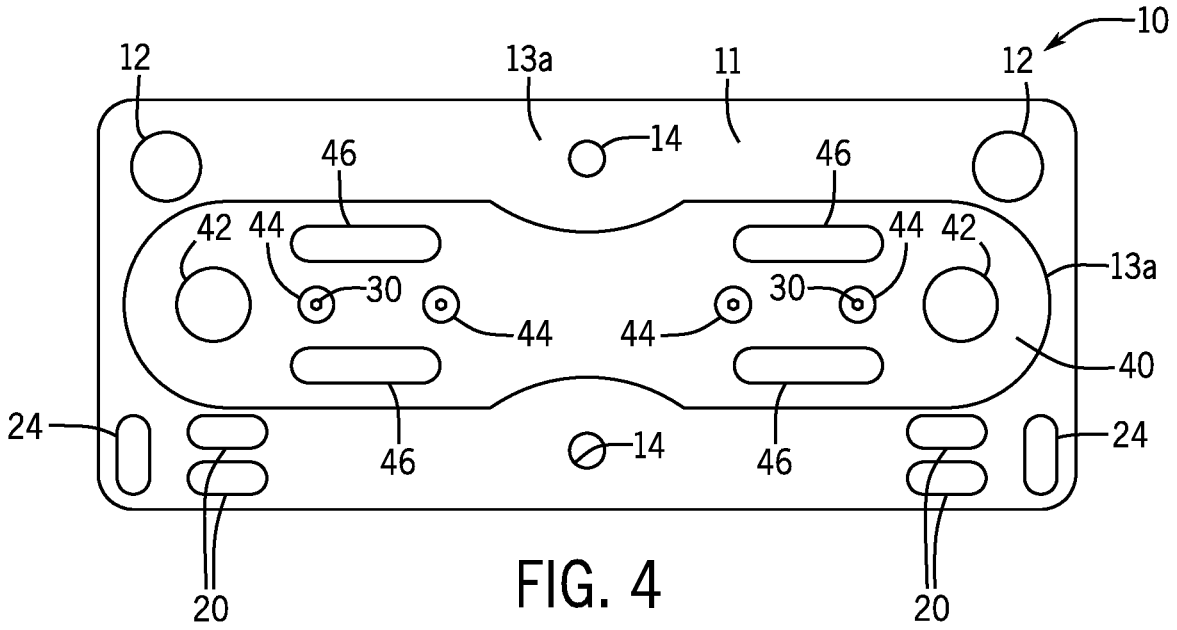
FIG. 4 is a front elevational view of the climbing board of FIG. 1 having an attached fingerboard as a climbing fixture oriented in a first orientation to present horizontal finger slots.

Referring now to FIG. 4, in one embodiment, the climbing board 10 may include a fingerboard 40 shown mounted in a first orientation against the front surface 13*a* of the panel 11. The fingerboard may also be nominal three-quarter inch plywood and may have a vertical height as depicted of approximately 3 inches and a lateral extent of about 19 inches. The fingerboard 40 includes support holes 42 at its left and right edges as depicted also sized to be within 1 to 2 inches of the edges of the fingerboard 40 to receive a carabiner 15 (shown in FIG. 1) therethrough. The separation of the mounting holes 42 is slightly more than the separation of the mounting support holes 12 in the panel 11 to provide an option for increased stability. Generally the mounting holes 42 allow the fingerboard 40 to be used separately from the panel 11.

As depicted the fingerboard 40 may be held against the panel 11 by means of bolts 30 passing through mounting holes 44 in the fingerboard 40 aligned with corresponding attachment holes 14 in the panel 11. Positioned inboard from the mounting holes 42 are pairs of vertically separated horizontal finger slots 46, for example, having a width of approximately 2¼ inches and a height of three quarters of an inch to receive the tips of the user's fingers for practice and building finger strength. A lower one of each pair of finger slots 46 may be a blind slot having a depth of approximately ½ inch while the upper of the slots 46 may be a through slot to provide slightly different depths for different finger grip challenge.

Figure 5:
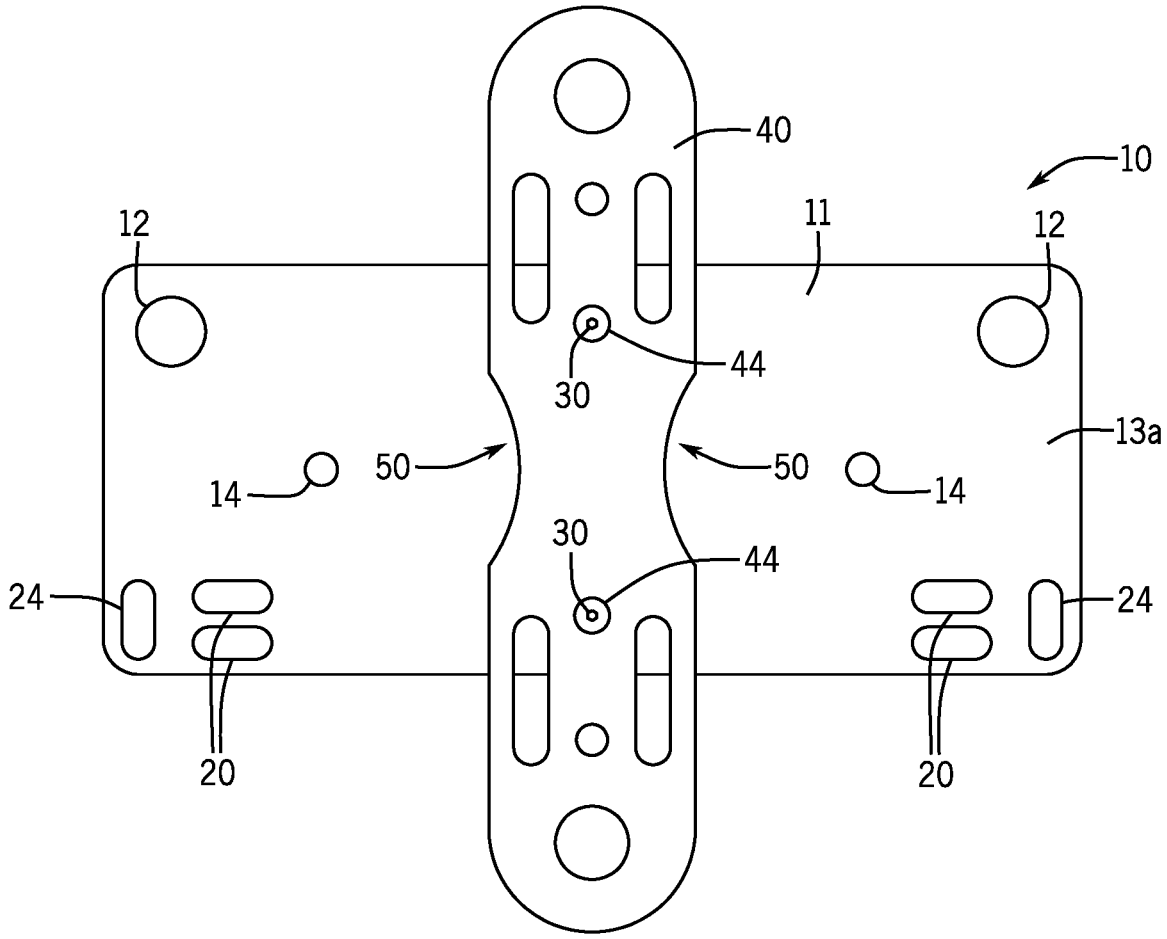
FIG. 5 is a figure similar to that of FIG. 4 showing the fingerboard in a second vertical orientation providing a pinch surface for grip strengthening.

Referring now to FIG. 5, the fingerboard 40 may also be mounted to the panel 11 in a vertical orientation, for example, using different attachment holes 14 and different mounting holes 44. In this orientation, the user's fingers may grip opposite left and right sides of the fingerboard 40 near its center at a narrowed, neck portion between outwardly concave cutouts 50, providing pinch grip training. It will be noted that these orientations of FIGS. 4 and 5 may also be achieved by rotation of the panel 11 rather than by the movement of the fingerboard 40.

Figure 6:
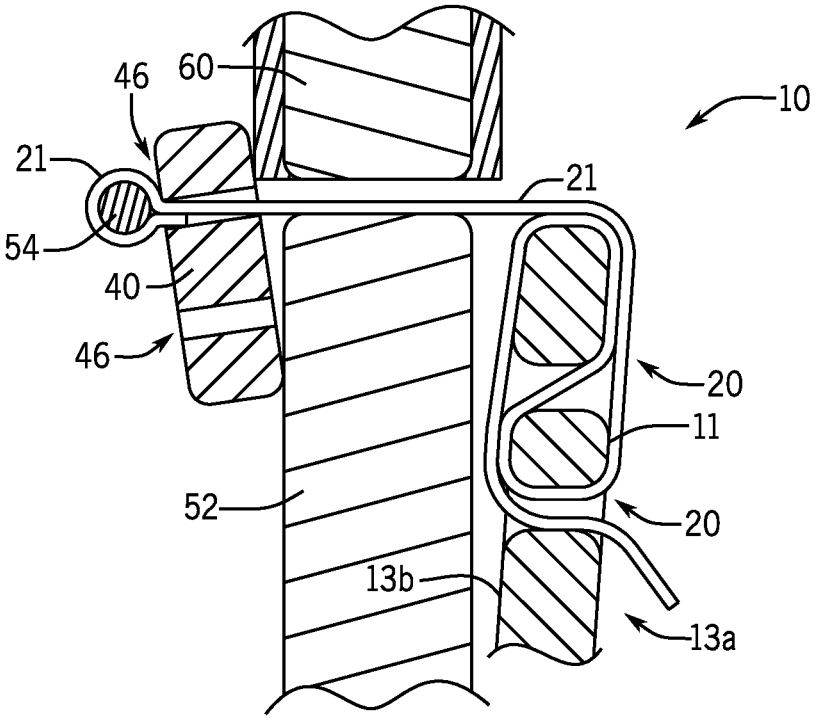
FIG. 6 is a fragmentary cross-sectional view through a closed door showing supporting of the board of FIG. 1 by straps over the top of the door chocked by means of the fingerboard of FIG. 5 in a detached state.

Referring now to FIG. 6, in one mounting technique, the panel 11 may be placed against the upper edge of a door 52 with the rear surface 13*b* placed against a front of the door with the strap slots 20 (or mounting support holes 12) positioned upward. At each left and right end of the panel 11, a corresponding strap 21 stabilized by dowel 22 may pass through strap slot 20 and up over the top of the door 52 to be received through a corresponding slot 46 of the fingerboard 40 positioned on the opposite side of the door 52. This end of the strap 21 may be cinched as shown. Downward force on the panel 11 pulls the fingerboard 40 against the door 52 and a corresponding portion of the door frame 60 above the door 52 as a chock thereby stabilizing and supporting the panel 11. This arrangement allows ready use of the climbing board 10 in the home or other indoor environment. Alternatively, when support holes 12 are used for mounting the panel 11 against the door 52, a continuous loop of strapping (not shown) may thread sequentially through the support holes 12 and over the top of the door 52 and sequentially through corresponding holes 42 on the opposite side of the door 52, the loop formed by a buckle on the rear side of the fingerboard 40.

Figure 7:
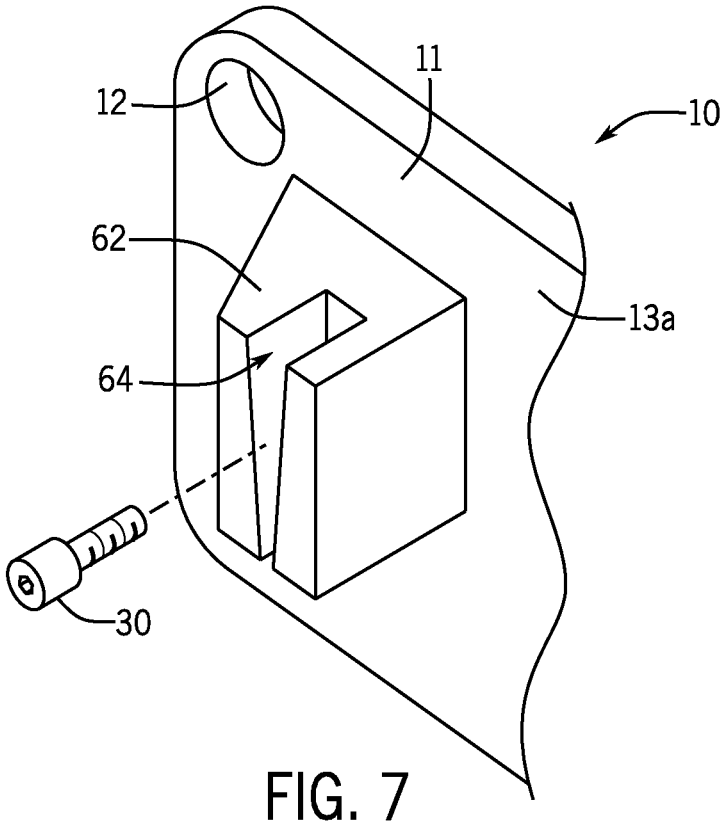
FIG. 7 is a detailed fragmentary view of a climbing fixture that provides practice using cam devices by presenting an outwardly open crack.

Referring now to FIG. 7, one climbing fixture may be a crack fixture 62 provided for practice with active or passive cams, chocks, stoppers, nuts jams and locks (henceforth crack gripping devices) and constructed of a sturdy material such as metal to present a vertically extending crack 64 that can allow practice using crack gripping devices such as climbing cams or the like that wedge themselves within such a crack; as before, this fixture 62 may be attached to the front surface 13*a* of the panel 11 using a bolt 30.

Figure 8:
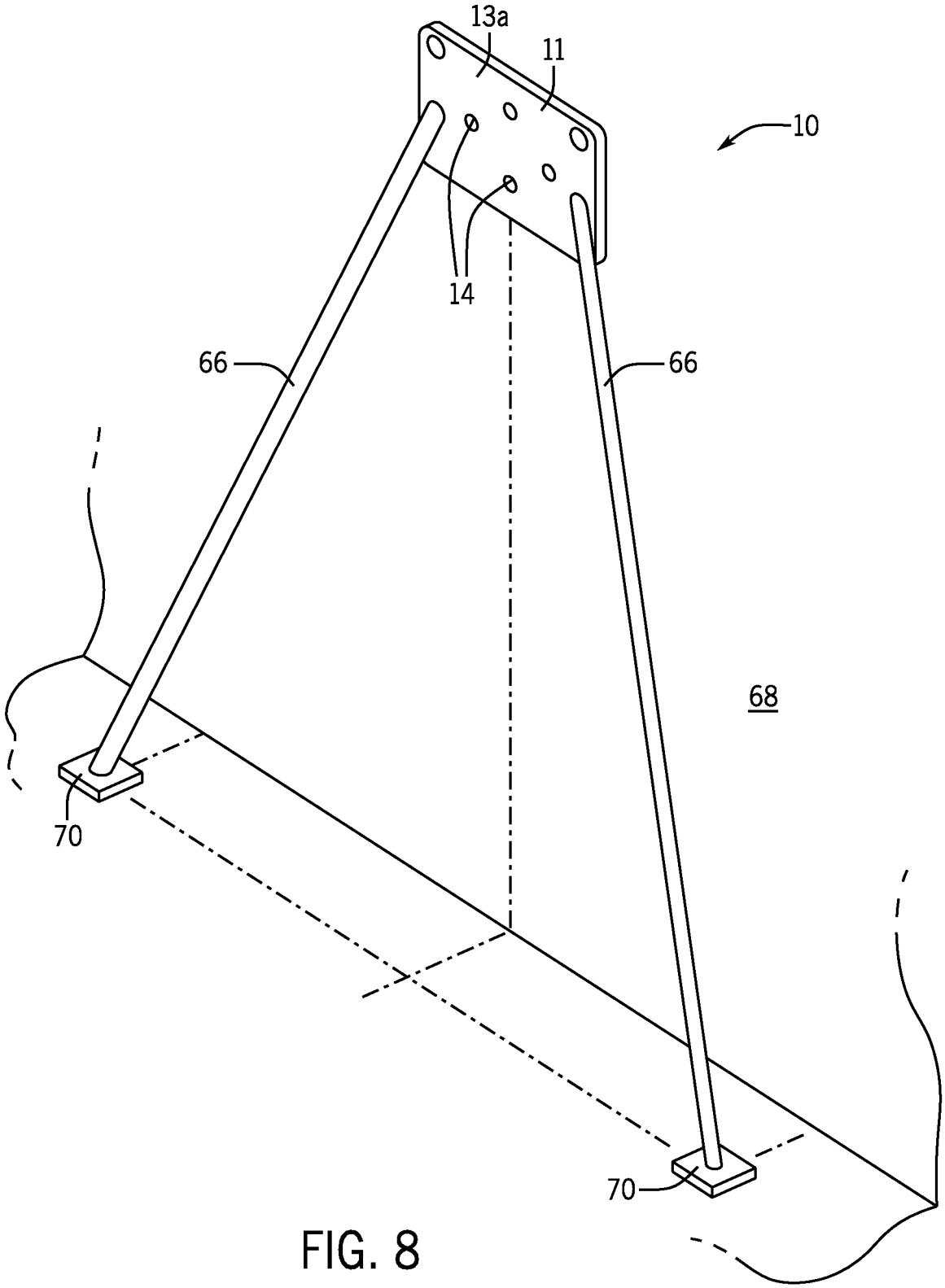
FIG. 8 is a front perspective view of an alternative embodiment of the climbing board having supporting legs.

Referring now to FIG. 8, in one embodiment, the climbing board 10 may provide legs 66 that extend downwards, outward (left and right, for example, by 5-30 degrees), and forward diagonally (for example, by 20-45 degrees) from a left and right side of the panel 11. The legs 66 may be made of a sturdy tubular aluminum or other lightweight alloy or material to support the weight of an individual using the climbing board 10 and may be attached to the front surface 13*a* of the panel 11.

As shown, the legs 66 may extend so that weight by the user on the climbing board 10 serves to press the climbing board 10 against the vertical wall 68. In this regard, the rear surface 13*b* of the panel 11 may include a resilient, gripping or high friction material to provide a gripping and reduced marring of the vertical surface 32. Likewise, lower ends of the legs 66 may include swivel feet 70 having an elastomeric gripping cushioning material on their surface to prevent sliding against the floor.

While the figures and description show discuss the climbing board 10 in a particular orientation, it should be understood that this orientation is not limiting and that the climbing board 10 can be used in other orientations as desired by the user. For example, in some applications, the climbing board 10 may be rotated 90° about a horizontal axis perpendicular to a front face of the panel 11 from the orientation depicted (oriented vertically) or by 180° (oriented horizontally) but inverted from the direction shown in the FIGS. 1 and 4.

Certain terminology is used herein for purposes of reference only, and thus is not intended to be limiting. For example, terms such as "upper," "lower," "above," and "below" refer to directions in the drawings to which reference is made. Terms such as "front," "back," "rear," "bottom," and "side" describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," and other such numerical terms referring to structures do not imply a sequence or order unless clearly indicated by the context.

When introducing elements or features of the present disclosure and the exemplary embodiments, the articles "a," "an," "the," and "said" are intended to mean that there are one or more of such elements or features. The terms "comprising," "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein, and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What we claim is:

1. A climbing practice board comprising:

a panel having a front surface having a lateral and vertical extent, the panel including:

at least a first and second attachment hole exposed at the front surface and holding corresponding threaded inserts, each for receiving and retaining a bolt for attaching a climbing fixture to the front surface of the panel; and at least two laterally opposed support holes positioned on opposite left and right sides of the panel and flanking the at least first and second attachment holes, the at least two laterally opposed support holes adapted to mount the panel to an elevated support with the front surface vertical for training a user of the climbing fixture;

further including the climbing fixture and wherein the climbing fixture is a rock bolt hanger providing a metal angle with a first attachment tab portion having a hole for receiving the bolt to attach the attachment tab portion against the front surface by tightening the bolt within the threaded insert and having a rear portion extending from the attachment tab portion providing an aperture for receiving therethrough a rope, strap, or carabiner; and wherein the at least two laterally opposed support holes are positioned above the at least first and second attachment holes when the front surface is vertical, and have a dimension along the front surface of at least three quarters of an inch, have rounded chamfers on their edges to receive ropes or straps with reduced cutting and wear, and are positioned within two inches of an upper horizontal edge of the panel to be engaged with a carabiner.

2. The climbing practice board of claim 1 wherein the at least first and second attachment holes comprise at least four attachment holes exposed at the front surface of the panel and holding corresponding threaded inserts for receiving and retaining the bolt for fixing the bolt hanger to the front surface of the panel.

3. The climbing practice board of claim 2 wherein the front surface has a lateral dimension of less than two feet and a vertical dimension of less than one foot and a thickness of less than two inches.

4. The climbing practice board of claim 3 wherein the panel is composed of plywood.

5. The climbing practice board of claim 2 wherein a rear face of the panel opposite the front surface includes at least one elastic bumper extending rearwardly from the rear face.

6. The climbing practice board of claim 1 further including a clip releasably supporting a smart phone.

7. The climbing practice board of claim 1 further including the climbing fixture and wherein the climbing fixture is a climbing hold having an outer irregular surface simulating a protrusion from a rocky face.

8. The climbing practice board of claim 1 further including the climbing fixture and wherein the climbing fixture is a climbing crack having first and second forwardly extending and opposed wall surfaces simulating a crack in a rocky wall that is adapted to receive a crack gripping device.

9. The climbing practice board of claim 1 further including at least two legs that extend downwards for supporting the panel above the ground.

10. A climbing practice board comprising:

a panel having a front surface having a lateral and vertical extent, the panel including:

at least a first and second attachment hole exposed at the front surface and holding corresponding threaded inserts, each for receiving and retaining a bolt for attaching a climbing fixture to the front surface of the panel; and at least two laterally opposed support holes positioned on opposite left and right sides of the panel and flanking the at least first and second attachment holes, the at least two laterally opposed support holes adapted to mount the panel to an elevated support with the front surface vertical for training a user of the climbing fixture; and further including the climbing fixture and wherein the climbing fixture is a fingerboard providing a second panel providing at least a first and second bolt hole adapted each for receiving and retaining the bolt to attach the second panel to the front surface using the at least first and second attachment holes in a first orientation, wherein the second panel in the first orientation provides at least one pair of laterally spaced finger slots sized to receive fingertips of the user for supporting the user by fingertips on the second panel.

11. The climbing practice board of claim 10 wherein the fingerboard is further adapted to receive the bolts to attach the second panel to the front surface using the at least first and second attachment holes and in a second orientation rotated with respect to the first rotation, wherein the second panel in the second orientation provides laterally opposed outwardly concave walls sized to support the user pinching inward on the concave walls with the user's fingertips.

12. The climbing practice board of claim 11 wherein the second panel provides second panel support holes at its opposite ends flanking the outwardly concave walls and finger slots.

13. The climbing practice board of claim 12 wherein the second panel support holes that have a dimension along the front surface of the fingerboard of at least three quarters of an inch, have rounded chamfers on their edges to receive ropes or straps with reduced cutting and wear, and are positioned within two inches of an outer edge of the fingerboard to be engaged with a carabiner.

14. The climbing practice board of claim 13 wherein the fingerboard is composed of plywood.

15. The climbing practice board of claim 12 further including a first and second strap each sized to connect between a corresponding second panel mounting hole and panel mounting hole and drape over an upper surface of a closed door to support the panel on the straps on a first side of the closed door retained against movement by the fingerboard abutting a second side of the closed door.

* * * * *